US010492604B2

(12) United States Patent
Gonzalez et al.

(10) Patent No.: US 10,492,604 B2
(45) Date of Patent: Dec. 3, 2019

(54) BEVERAGE IN BOX CART

(71) Applicant: SPG INTERNATIONAL LLC, Covington, GA (US)

(72) Inventors: Arturo Gonzalez, Lilburn, GA (US); Steven M. Kessell, Loganville, GA (US)

(73) Assignee: SPG INTERNATIONAL LLC, Covington, GA (US)

( * ) Notice: Subject to any disclaimer, the term of this patent is extended or adjusted under 35 U.S.C. 154(b) by 46 days.

(21) Appl. No.: 15/568,663

(22) PCT Filed: Apr. 22, 2016

(86) PCT No.: PCT/US2016/028961
§ 371 (c)(1),
(2) Date: Oct. 23, 2017

(87) PCT Pub. No.: WO2016/172563
PCT Pub. Date: Oct. 27, 2016

(65) Prior Publication Data

US 2018/0116393 A1 May 3, 2018

Related U.S. Application Data

(60) Provisional application No. 62/151,917, filed on Apr. 23, 2015.

(51) Int. Cl.
*B62B 3/00* (2006.01)
*A47B 31/04* (2006.01)

(52) U.S. Cl.
CPC ..... *A47B 31/04* (2013.01)

(58) Field of Classification Search
CPC ... A47B 31/00; A47B 31/04; A47B 2003/002; A47B 2003/003; A47B 2003/005;
(Continued)

(56) References Cited

U.S. PATENT DOCUMENTS 2,377,815 A 6/1945 Sides et al.
2,429,034 A * 10/1947 Smith ..... B62B 3/02 280/641

(Continued)

FOREIGN PATENT DOCUMENTS

GB 903002 A 8/1962
GB 921452 A 3/1963

OTHER PUBLICATIONS

PCT/US2016/028961 International Search Report and Written Opinion from the International Searching Authority dated Jul. 29, 2016 (8 pages).

(Continued)

*Primary Examiner* — James M Dolak
(74) *Attorney, Agent, or Firm* — Michael Best & Friedrich LLP

(57) ABSTRACT

A cart for moving product over a floor surface includes a folding frame assembly having a first shelf support member and a second shelf support member pivotable with respect to the first shelf support member. A shelf is pivotable with respect to the first shelf support member and supportable by the second shelf support member. The second shelf support member and the shelf are movable between a first operable position and a second stored position. The second shelf support member and shelf are both rotatable relative to the first shelf support member when moving from the first operable position to the second stored position.

20 Claims, 8 Drawing Sheets

(58) Field of Classification Search
CPC ... A47B 2003/008; B62B 3/002; B62B 3/005; B62B 3/106; B62B 3/02; B62B 3/00; B62B 3/022; B62B 3/027; B62B 3/10; B62B 3/1464; B62B 3/1496; B62B 2205/20; B62B 2205/30; B62B 2205/32; B62B 2205/33; B62B 2202/12; B62B 2202/67
See application file for complete search history.

(56) References Cited

U.S. PATENT DOCUMENTS

| | | | | | |
|---|---|---|---|---|---|
| 2,599,380 | A | * | 6/1952 | Galvin | A47F 5/13 211/130.1 |
| 2,921,694 | A | * | 1/1960 | Decker | A47F 5/01 108/101 |
| 2,965,236 | A | | 12/1960 | Klein | |
| 3,074,734 | A | * | 1/1963 | Munson | A47B 31/04 108/178 |
| 3,746,358 | A | | 7/1973 | Swick, Jr. et al. | |
| 3,827,573 | A | | 8/1974 | Guerette | |
| 3,840,243 | A | | 10/1974 | Rheinhart et al. | |
| 3,856,320 | A | * | 12/1974 | Blanchard | B62B 3/02 211/187 |
| 3,981,511 | A | * | 9/1976 | Foster | B62B 3/08 280/79.3 |
| 4,864,334 | A | * | 9/1989 | Ellis | B62B 1/26 396/419 |
| 4,928,853 | A | | 5/1990 | Isham et al. | |
| 5,339,874 | A | | 8/1994 | Cragun | |
| 5,450,882 | A | | 9/1995 | Cragun | |
| 5,626,352 | A | | 5/1997 | Grace | |
| 5,730,452 | A | * | 3/1998 | Fields | B62B 3/006 108/179 |
| 5,816,419 | A | * | 10/1998 | Lamson | A47B 57/045 211/150 |
| 6,105,797 | A | * | 8/2000 | Haisma | A47F 5/137 211/130.1 |
| 6,364,328 | B1 | * | 4/2002 | Stahler, Sr. | B62B 1/002 280/47.18 |
| 6,554,164 | B1 | * | 4/2003 | Jones | B65D 77/068 222/105 |
| 8,632,293 | B2 | | 1/2014 | Thogersen | |
| 9,004,300 | B1 | * | 4/2015 | Morrell | A47F 5/137 108/107 |
| 9,259,085 | B2 | * | 2/2016 | Reinbigler | A47B 57/04 |
| 9,655,448 | B2 | * | 5/2017 | Tiilikainen | B62B 3/005 |
| 9,714,045 | B2 | * | 7/2017 | Dhand | B62B 5/06 |
| 10,239,545 | B2 | * | 3/2019 | Khubani | B62B 1/12 |
| 10,252,737 | B2 | * | 4/2019 | Nowe | A01G 9/143 |
| 2003/0075887 | A1 | | 4/2003 | Malone, Jr. | |
| 2004/0256818 | A1 | | 12/2004 | Amsili | |
| 2006/0179562 | A1 | | 8/2006 | Huber | |
| 2014/0209634 | A1 | | 7/2014 | Metropulos et al. | |

OTHER PUBLICATIONS

Extended European Search Report, European Application No. 16783988.5, dated Sep. 11, 2018 (9 pages).

* cited by examiner

BEVERAGE IN BOX CART

BACKGROUND OF THE INVENTION

The present disclosure relates to a shelved cart, and more particularly to a foldable shelved cart.

SUMMARY

In one aspect, a cart for moving product over a floor surface includes a folding frame assembly having a first shelf support member, a caster wheel coupled to the first shelf support member, a second shelf support member rotatably coupled to the first shelf support member, the second shelf support member including a first shelf support bar and a second shelf support bar, and a caster wheel coupled to the second shelf support member. A first shelf having an open end, a closed end, and a pair of sidewalls, the first shelf is rotatably coupled to the first shelf support member and engageable with the first shelf support bar. A second shelf having an open end, a closed end, and a pair of sidewalls, the second shelf is rotatably coupled to the first shelf support member and engageable with the second shelf support bar. A locking member disposed on at least one of the first and the second shelf to releasably engage the shelf with the first or the second shelf support bar, respectively. The locking member includes a sloped surface, a recess, a keyway, and a user interface. The locking member is movable along an axis defined by the keyway. The cart is movable between an unfolded state in which the second shelf support member is rotated away from the first shelf support member and the first and second shelves each engage the corresponding shelf support bar and are each angled between 5 and 25 degrees relative to the floor surface, and a folded state in which the second shelf support member is rotated toward the first shelf support member and the first and second shelves are each angled between 75 and 90 degrees relative to the floor surface. The closed end of each of the first and the second shelf includes a notch, and the first and second shelves are configured to support a container having a dispenser sized to fit into the notch of each shelf In another aspect, a cart for moving product over a floor surface includes a folding frame assembly having a first shelf support member and a second shelf support member pivotable with respect to the first shelf support member. A shelf is pivotable with respect to the first shelf support member and supportable by the second shelf support member. The second shelf support member and the shelf are movable between a first operable position and a second stored position. The second shelf support member and shelf are both rotatable relative to the first shelf support member when moving from the first operable position to the second stored position.

In another aspect, a cart for moving product over a floor surface includes a folding frame assembly having a first shelf support member and a second shelf support member pivotable with respect to the first shelf support member. A shelf including an open end, a closed end, and a pair of sidewalls is rotatably coupled to the first shelf support member and lockably engageable with the second shelf support member. The second shelf support member and the shelf are movable between a first position, in which the shelf is supported at an angle of between 5 and 25 degrees relative to the floor surface, and a second position in which the second shelf support member and shelf are both rotatable relative to the first shelf support member.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

Figure 1:
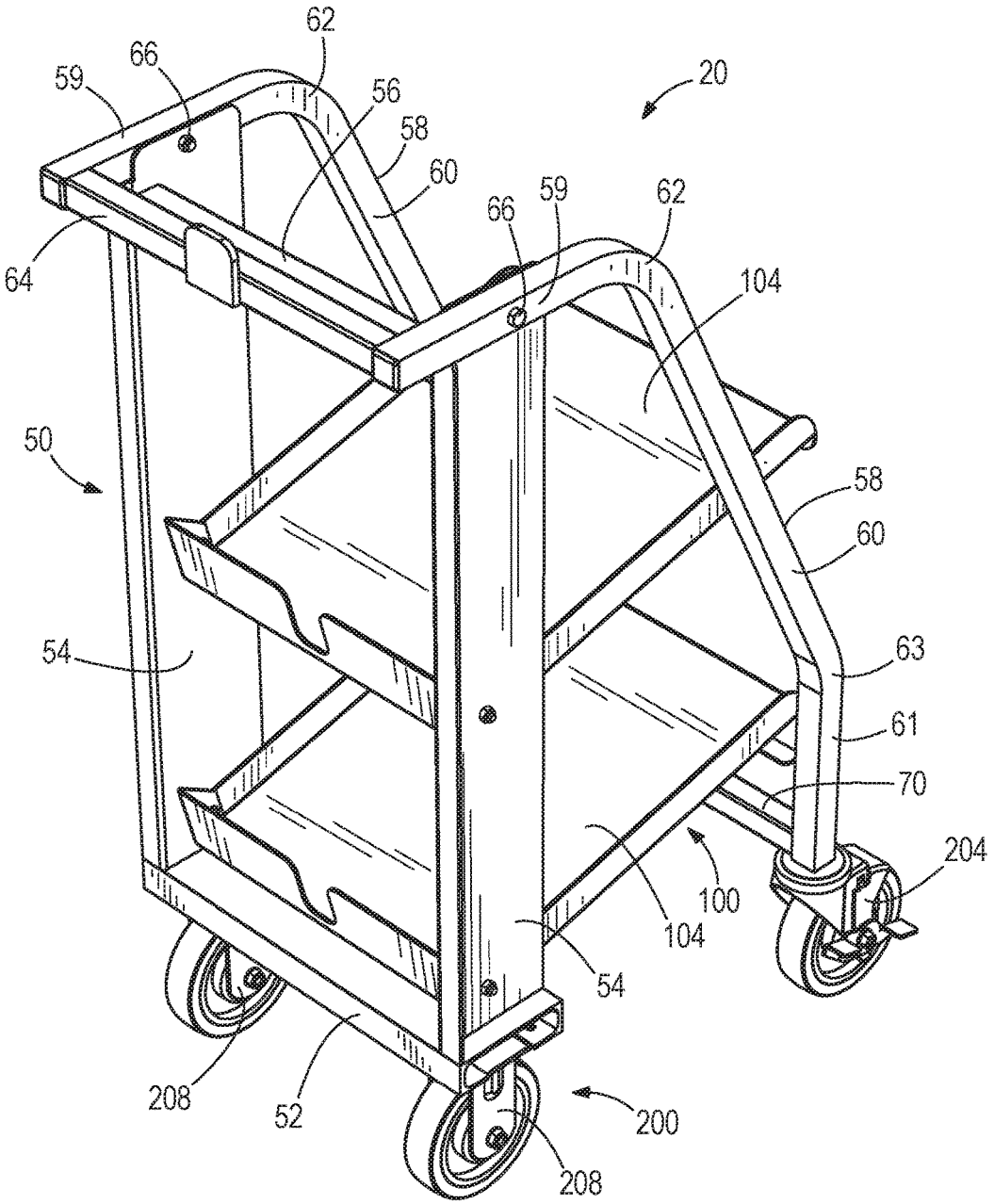
FIG. 1 is perspective view of a cart.
Figure 3:
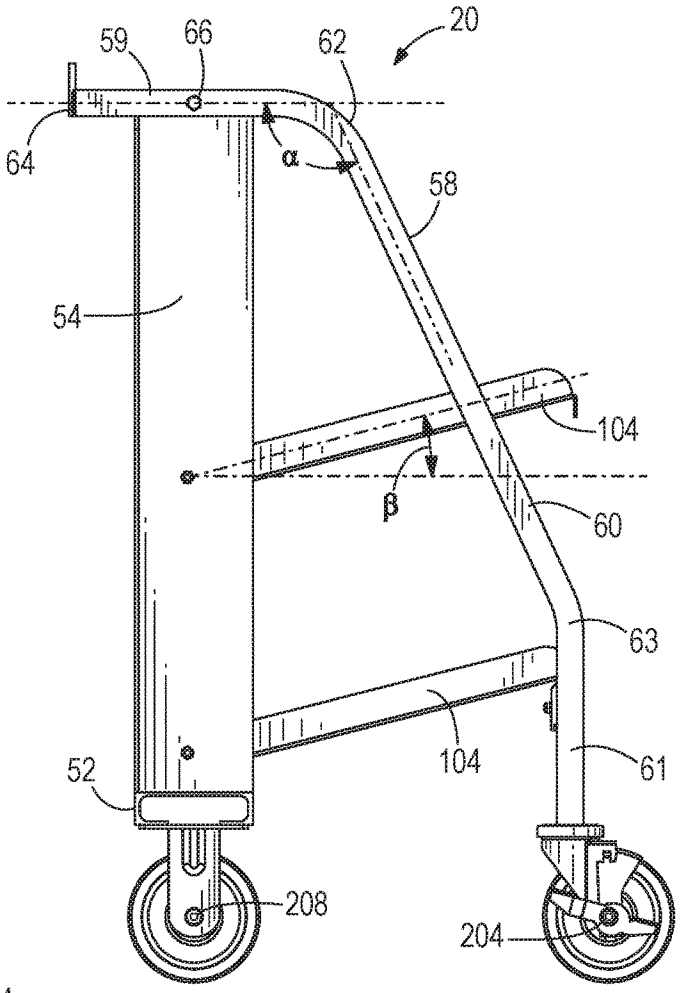
FIG. 3 is a side view of the cart of FIG. 1.

FIG. 1 illustrates a shelved cart 20. In this exemplary construction, the cart 20 includes a folding frame assembly 50, a shelf assembly 100 having a locking mechanism 150 (see FIGS. 5 and 6), and a wheel assembly 200. As is described further below, the cart 20 is designed to be portable and storable by collapsing the folding frame assembly 50 and shelf assembly 100 into a folded state.

With reference to FIGS. 1-4, the folding frame assembly 50 includes a base member 52, a pair of vertically disposed and generally parallel shelf support members 54 fixedly attached to opposing ends of the base member 52, and a connecting member 56. Two curved shelf support members or rails 58, joined by connecting arms 64, 70 extending therebetween, are coupled to associated support members 54 by rotatable couplings 66, e.g., pins. The folding frame assembly 50 may be constructed from a metal (e.g., aluminum) in order to increase durability and cleanability while maintaining a relatively low weight. Any other suitable materials may be used, however.

According to this construction, the curved rails 58 generally define three linear sections 59, 60, 61 linked by a first and a second curved section 62, 63. The first linear section 59 of each rail 58 is rotatably coupled to a respective support member 54 through one of the coupling pins 66 and is continuous with the second linear section 60 through the first curved section 62. The second linear section 60 is angled relative to the first linear section 59 by an angle $\alpha$ of approximately 100-130°, or more specifically about 115°.

The second linear section 60 is continuous with the third linear section 61 through the second curved section 63.

At least one shelf support bar 74 extends between the curved rails 58 within the linear section 60 and/or the linear section 61 (two support bars 74 are shown in the figures).

The wheel assembly 200 includes rotatable caster wheels 204 and fixed caster wheels 208. In this embodiment, the fixed caster wheels 208 are coupled to a bottom side of the base member 52, while the rotatable caster wheels 204 are coupled to the third linear sections 61 of the curved rails 58. In other embodiments, either of the caster wheels 204, 208 could be fixed or rotatable.

Figure 2:
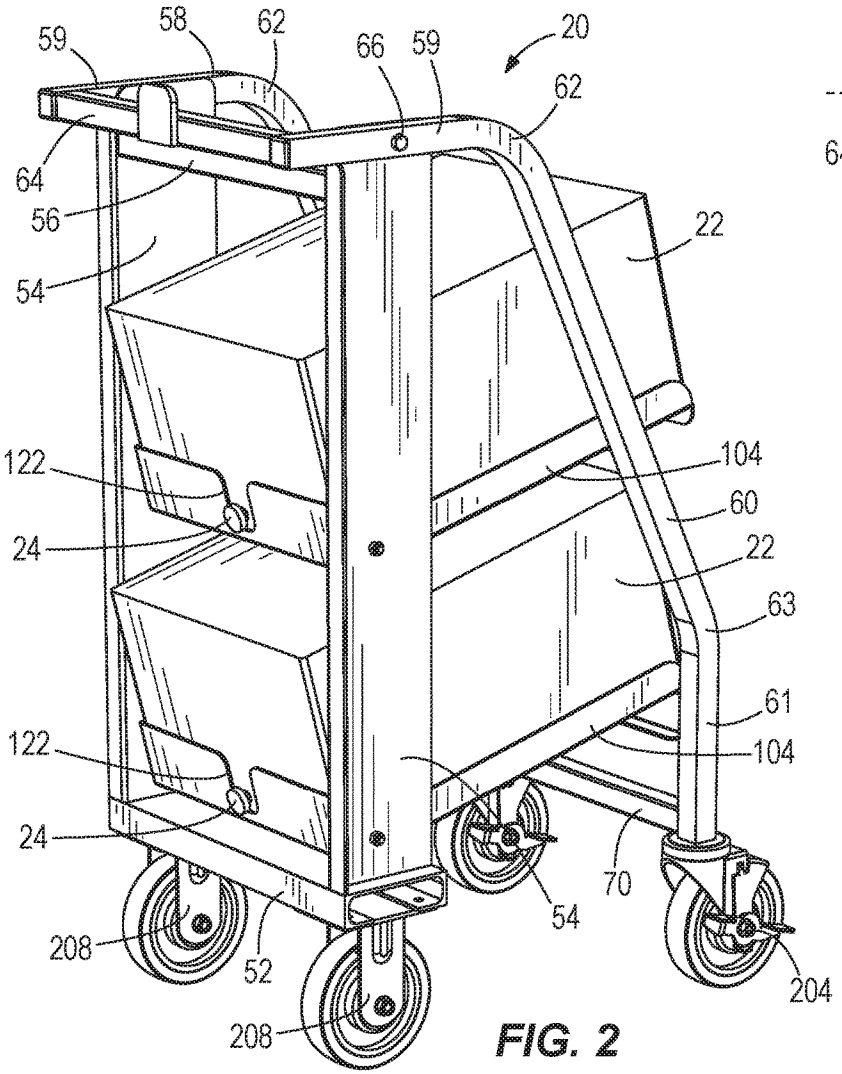
FIG. 2 is a perspective view of the cart of FIG. 1 supporting two containers.
Figure 4:
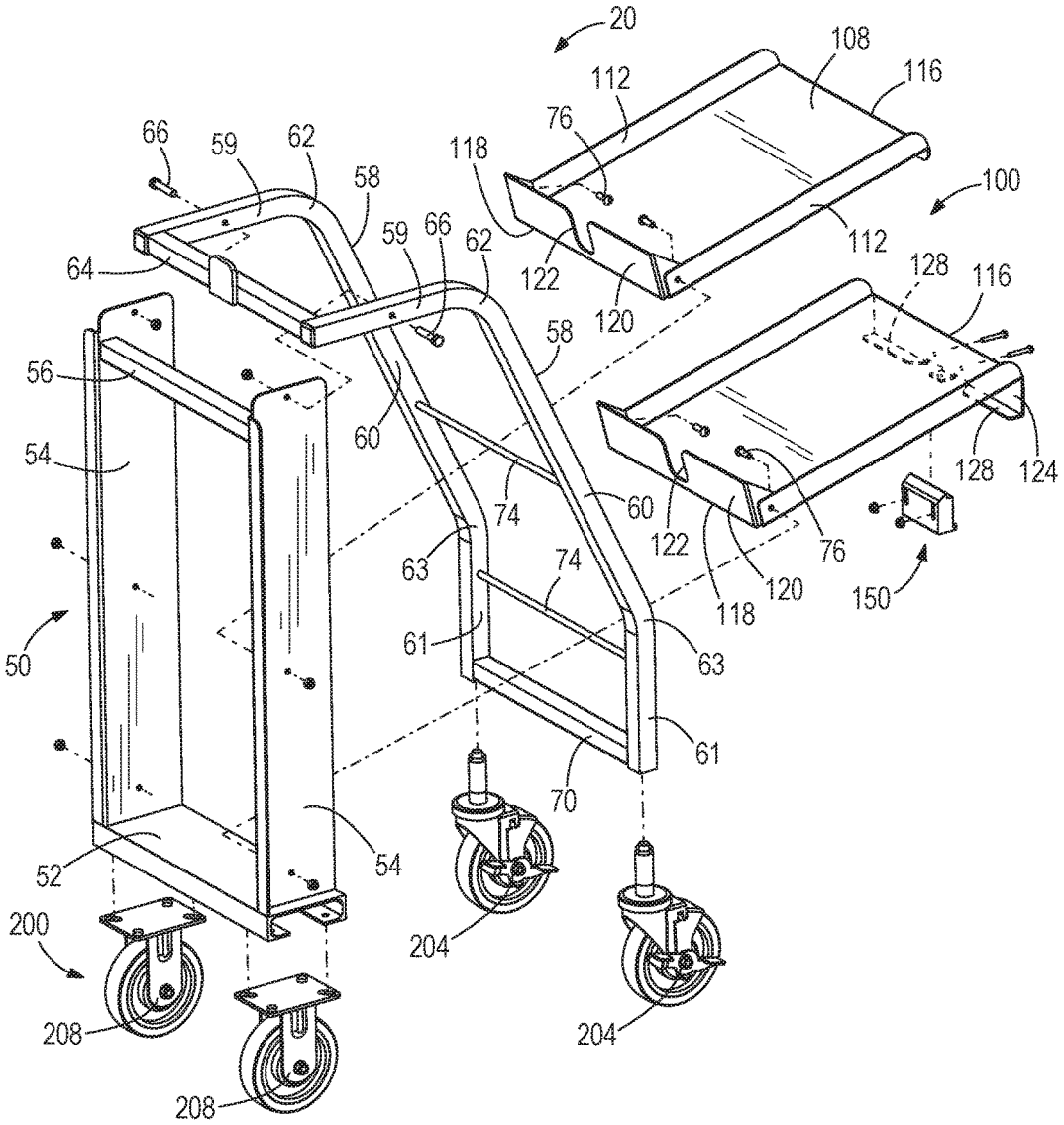
FIG. 4 is an exploded view of the cart of FIG. 1.

With reference to FIGS. 1-4, the shelf assembly 100 includes one or more shelves 104, each of which supports at least one "beverage-in-box" (BIB) container 22 holding a food product such as syrup to be mixed into water or other liquids to create a beverage. Each shelf 104 is substantially rectangular and includes a support surface 108 defined between a pair of sidewalls 112. One end of the shelf defines an open or loading end 116 and the end opposite defines a closed end 118 with a retaining wall 120. The retaining wall 120 includes a centrally located notch 122 sized and shaped to receive, for example, a dispenser 24 of a BIB container 22 (FIG. 2). Each shelf is positioned at an angle β of between approximately 5° and 25°, or more specifically about 15°, from the horizontal or floor surface to facilitate full evacuation of the food product contained within the BIB container 22. The shelves 104 may be constructed from a metal, such as aluminum, though other suitable materials may also be used.

According to this construction, two shelves 104 are mounted on the cart 20. In other constructions, the number of shelves 104 and corresponding shelf support bars 74 may vary, e.g., three or more. Furthermore, the shelf 104 may be wider than illustrated with a retaining wall 120 having two or more notches 122 to create a shelf 104 that may support two or more BIB containers 22 and their dispensers 24 (e.g., a "double wide", "triple wide", etc., shelf 104). Alternatively, the shelf 104 may be lengthened to support two or more BIB containers lengthwise on the shelf (e.g., a "double long", "triple long", etc., shelf 104). In these alternative constructions, it may be advantageous to alter the angle of the shelf to further facilitate full evacuation of the food product. For example, in the "double long" shelf construction, the angle β may be approximately 3° to 23°, or preferably about 12°.

The shelves 104 are each rotatably coupled to the support members 54 by rotatable couplings 76 near the closed end 118 and are supported by a shelf support bar 74 near the open end 116.

Referring to FIGS. 4 and 5-7, one of the shelves 104 further includes a flange or protrusion 124 at the open end 116 extending orthogonally from the surface 108. The locking mechanism 150 is disposed on the protrusion 124 between a pair of ledges 128 and is configured to detachably couple the shelf 104 to the shelf support bar 74.

The locking mechanism 150 includes a locking member 154 coupled to the protrusion 124 by fasteners 158. Keyways or slots 162 on a first face are shaped to receive the respective fasteners 158 and also define parallel axes A along which the locking member 154 may be displaced. The upper portion of the member 154 forms a sloped face 168 and a recess 170 for receiving the support bar 74. A user interface member 172 extends from the locking member 154 in a direction away from the closed end 118 for user accessibility.

Figure 5:
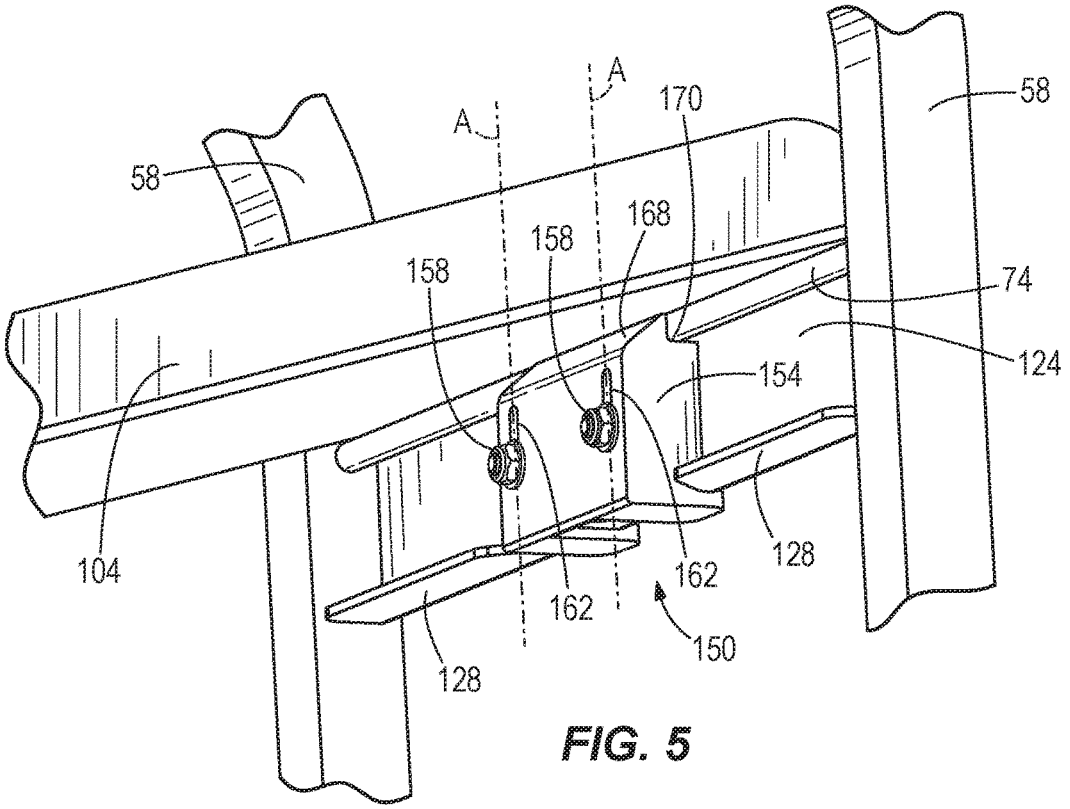
FIG. 5 is an enlarged view of a locking assembly of the cart of FIG. 1.
Figure 6:
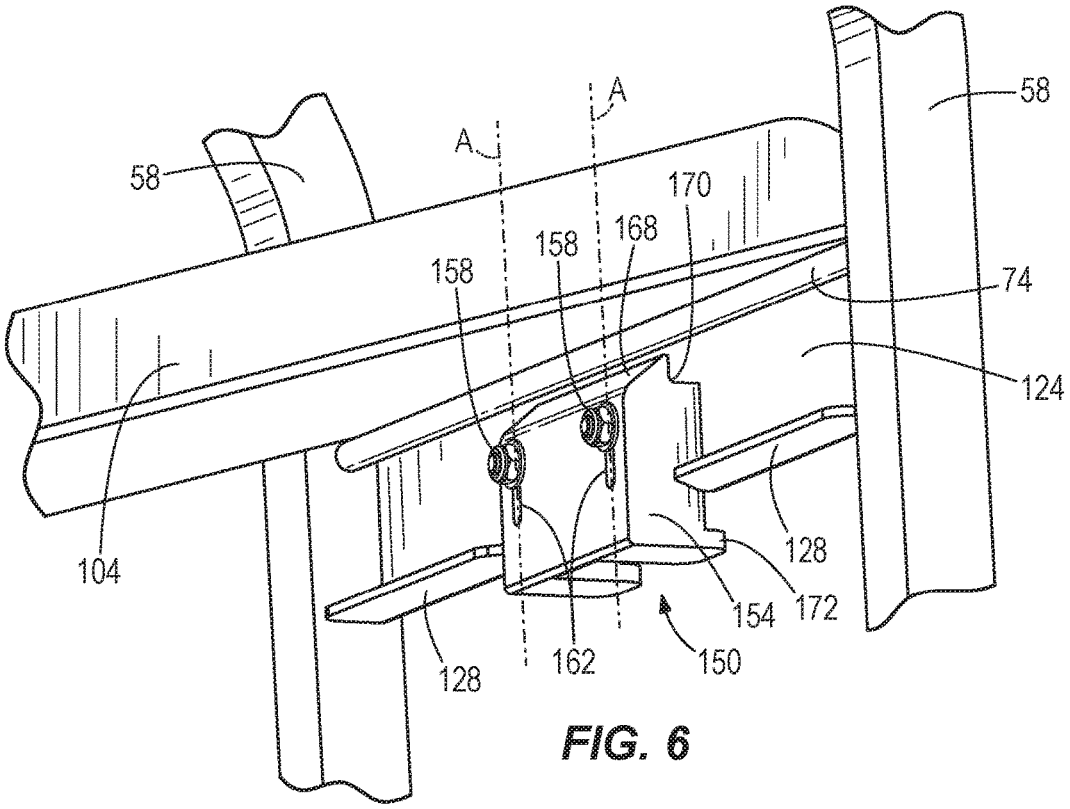
FIG. 6 is an enlarged view of the locking assembly of the cart of FIG. 1 in a partially disengaged state.
Figure 7:
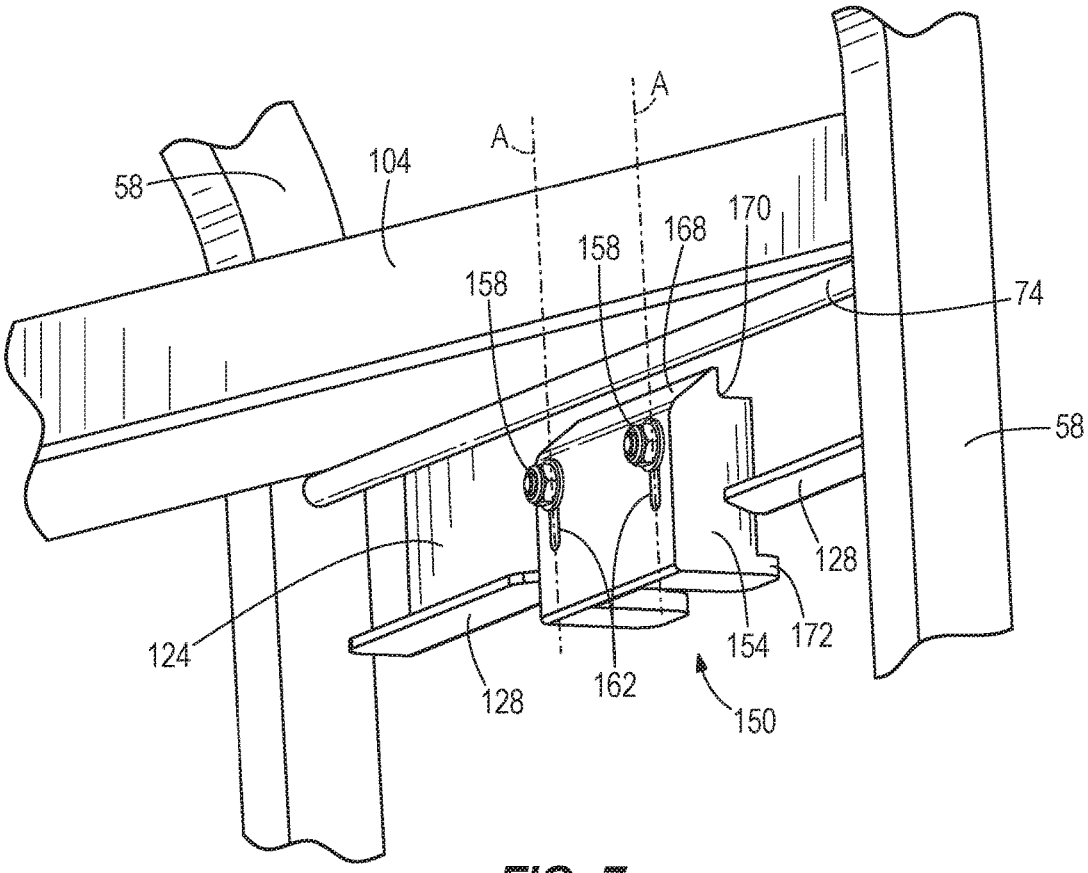
FIG. 7 is an enlarged view of the locking assembly of the cart of FIG. 1 in a disengaged state.

As shown in FIGS. 5-7, the locking member 154 is movable between an engaged position, in which the locking member 154 engages the shelf support bar 74 via the recess 170 (FIG. 5), and a disengaged position, in which the locking member 154 is free from the shelf support bar 74 (FIGS. 6 and 7). In the engaged position shown in FIG. 5, the shelf support bar 74 is captured in recess 170 between the locking member 154 and flange 124 thereby locking in place curved rails 58 in their fully extended position relative to support members 54. That is, when locking member 154 is engaged with support bar 74, curved rails 58 are locked from rotation relative to support members 54. According to this construction, the locking member 154 includes an internal biasing member, such as a spring, to bias the locking member 154 to the engaged position.

In operation, each shelf 104 is usable to support and move containers 22 on the cart 20 from one location to another. The locking member 154 of the locking mechanism 150 is in the engaged position during container transport such that the shelf 104 and curved rails 58 are rotationally fixed relative to the support members 54.

Figure 8:
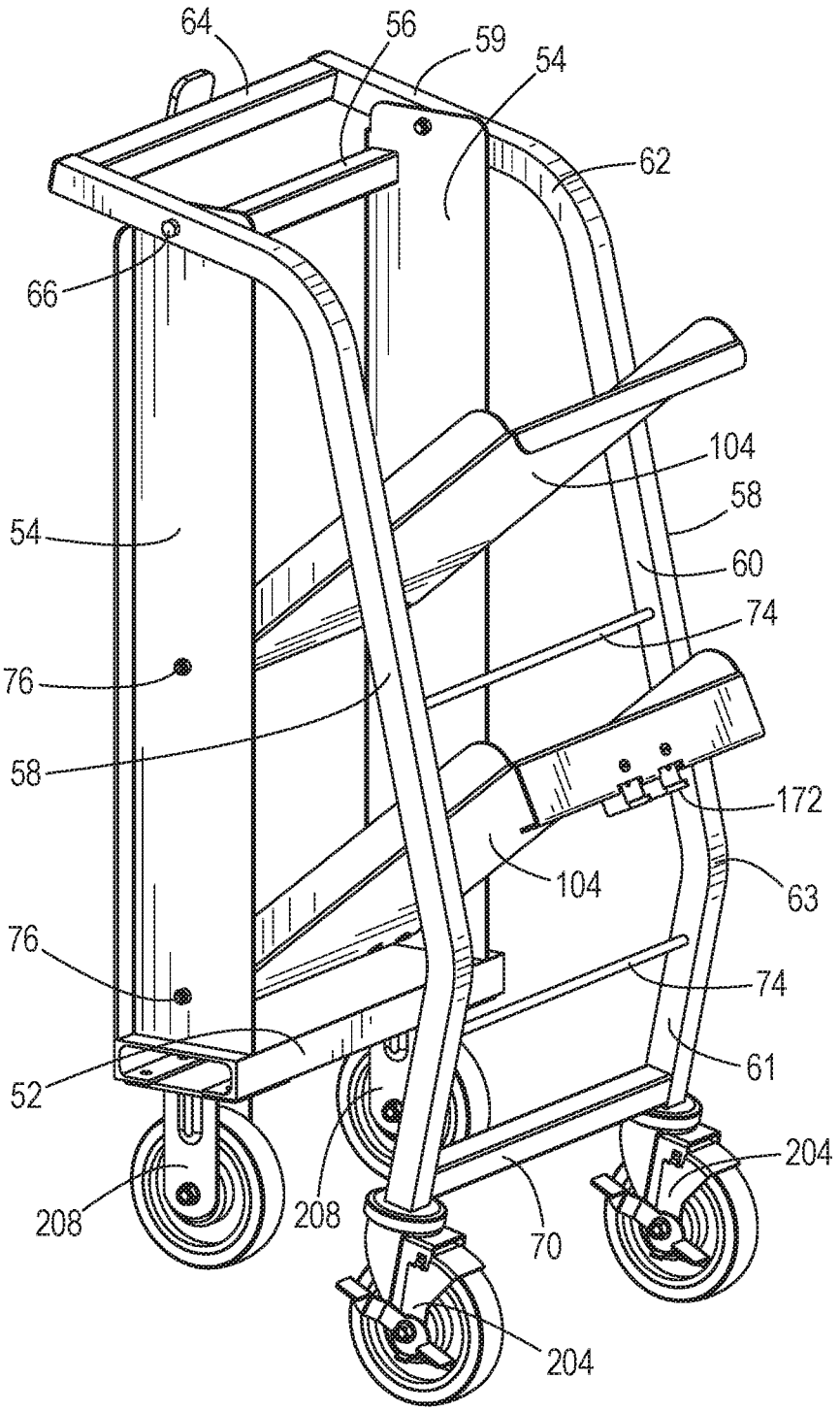
FIG. 8 is a perspective view of the cart of FIG. 1 in a partially folded state.

When not in use, the cart 20 may be folded in order to make the cart 20 easier to store or transport. As shown in FIGS. 5-7, the locking mechanism 150 may be operated to disengage the shelf support bar 74. To accomplish this, a user grasps the user interface 172 of the locking member 154 and pulls locking member 154 in a direction away from the support bar 74. Pulling locking member 154 away from support bar 74 acts against the biasing member to translate the locking member 154 along the axes A, disengaging the recessed face 170 from the shelf support bar 74 (FIG. 6). Once the locking member 154 is disengaged from the support bar 74, the support bar is no longer captured in recess 170 between the locking member 154 and flange 124. Thus, after locking member 154 is disengaged from support bar 74, curved rails 58 are free to rotate about couplings 66 and are no longer locked in their fully extended position relative to support members 54. The user then rotates the curved rails 58 about the couplings 66 toward the support members 54 (FIG. 7) while rotating the shelves 104 in a counterclockwise direction (viewed from FIG. 8).

Figure 9:
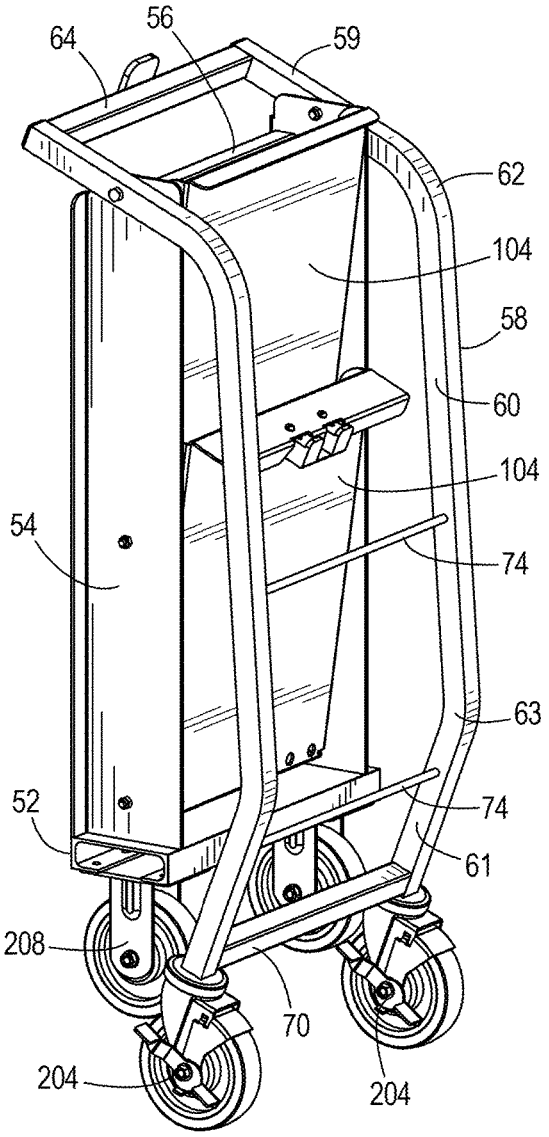
FIG. 9 is a perspective view of the cart of FIG. 1 in a fully folded state.
Figure 10:
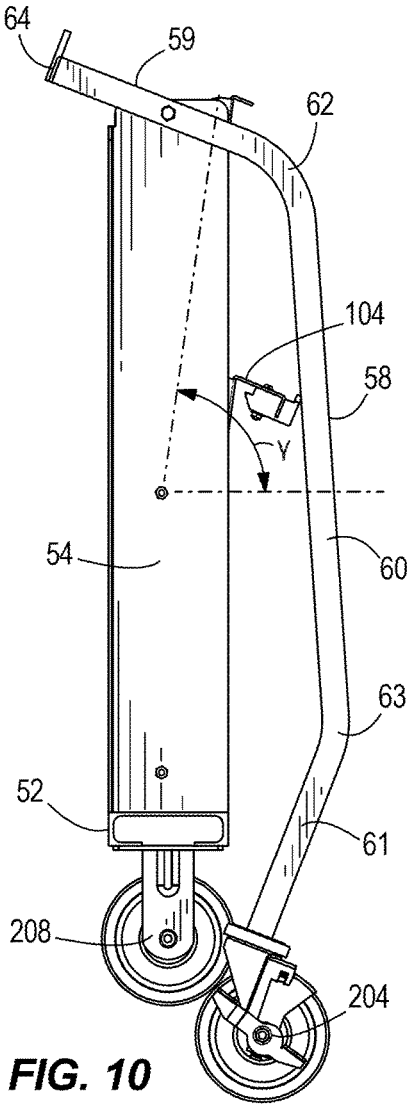
FIG. 10 is a side view of the cart of FIG. 9.

Once folding of both the curved rails 58 and the shelves 104 is complete, the cart 20 is in a folded state. As shown in FIGS. 9 and 10, when in the folded state the curved rails 58 are aligned such that the second linear portion 60 is close to parallel with the support members 54. The shelves 104 are also closely aligned with the support members 54 to define an angle γ of between approximately 70° and 90° from the horizontal or floor surface. In the folded state, the cart 20 occupies substantially less space than in the operational state, facilitating compact storage and transport of the unused cart 20.

Figure 12:
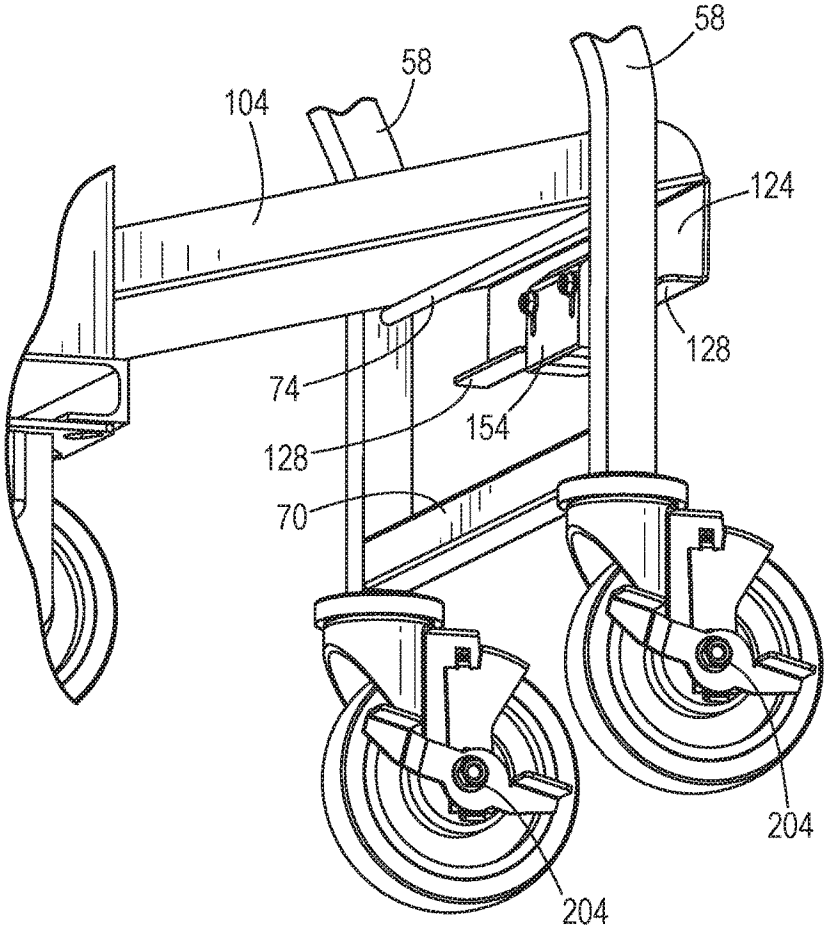
FIG. 12 is an enlarged view of a portion of the cart of FIG. 1 in a second partially unfolded state.
Figure 11:
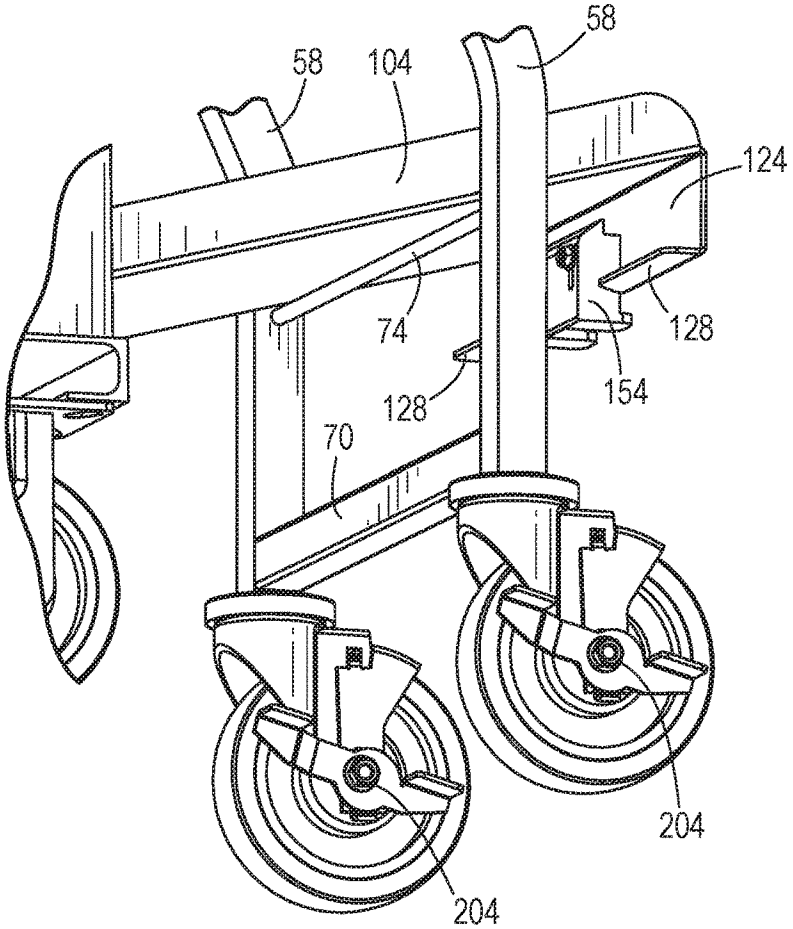
FIG. 11 is an enlarged view of a portion of the cart of FIG. 1 in a first partially unfolded state.

When the cart 20 is desired for use, it may be unfolded. The cart 20 is unfolded in a similar manner to the folding process, except in reverse. As shown in FIGS. 11 and 12, after the shelf or shelves 104 are rotated into contact with the shelf support bar 74, completion of the unfolding is accomplished by continued rotation of the curved rails 58 away from the support members 54. During this motion, the shelf support bar 74 comes into contact with the sloped face 168 of the locking member 154. Continued motion of the support bar 74 against the sloped face 168 (with additional rotation of the curved rails 58) forces or cams the locking member 154 downward along axes A and against the biasing member. Continued rotation of the curved rails 58 passes or cams the shelf support bar 74 over the sloped face 168, at which point the biasing member forces the locking member 154 upward to engage the shelf support bar 74 within the recess 170, placing the locking mechanism 150 into the engaged state. With the support bar 74 captured in the locking member recess 170 between the locking member 154 and flange 124, curved rails 58 are locked against rotation about couplings 66 in their fully extended position relative to support members 54. The cart 20 is thus returned to the unfolded configuration shown in FIGS. 1-3 and is ready for use.

Although specific embodiments are explained in detail, the disclosure is not limited to the details of construction and arrangement of components set forth in the described embodiments but is capable of other embodiments and of being carried out in various ways.

What is claimed is:

1. A cart for moving product over a floor surface, the cart comprising:

a folding frame assembly including a first shelf support member, a wheel coupled to the first shelf support member, a second shelf support member rotatably coupled to the first shelf support member, the second shelf support member including a first shelf support bar and a second shelf support bar, and a wheel coupled to the second shelf support member;

a first shelf to support a container, the first shelf having an open end, a closed end, and a pair of sidewalls, the first shelf being rotatably coupled to the first shelf support member about a pivot point on the first shelf support member and engageable with the first shelf support bar;

a second shelf to support a container, the second shelf having an open end, a closed end, and a pair of sidewalls, the second shelf being rotatably coupled to the first shelf support member about a pivot point on the first shelf support member and engageable with the second shelf support bar; and a locking member disposed on one of the first shelf and the second shelf to releasably engage the first shelf with the first shelf support bar or the second shelf with the second shelf support bar, respectively, the locking member including a sloped surface, a recess, a keyway, and a user interface, the locking member being movable along an axis defined by the keyway, wherein the cart is movable between an unfolded state in which the second shelf support member is rotated away from the first shelf support member and one of the first shelf and the second shelf engages one of the corresponding first shelf support bar and second shelf support bar and each of the first shelf and the second shelf is inclined at a first angle relative to the floor surface, and a folded state in which the second shelf support member is rotated toward the first shelf support member and the first shelf and the second shelf are each inclined at a second angle greater than the first angle relative to the floor surface, wherein the second shelf support member is rotatably coupled to the first shelf support member such that the locking member releasably engages one of the first shelf with the first support bar or the second shelf with the second shelf support bar in the unfolded state, and wherein the closed end of each of the first shelf and the second shelf includes a notch that is sized to receive a container dispenser.

2. The cart of claim 1, wherein the first shelf and the second shelf are each angled at 15 degrees relative to the floor surface in the unfolded state.

3. The cart of claim 1, wherein the first shelf and the second shelf are each angled at 12 degrees relative to the floor surface in the unfolded state.

4. The cart of claim 1, wherein the sloped surface of the locking member contacts one of the first shelf support bar or the second shelf support bar in the unfolded state.

5. A cart for moving product over a floor surface, the cart comprising:

a folding frame assembly including a first shelf support member, and a second shelf support member pivotably coupled to the first shelf support member about a pivot point on the first shelf support member; and a shelf pivotably coupled to the first shelf support member about a pivot point on the first shelf support member and supportable by the second shelf support member, wherein the second shelf support member and the shelf are movable between a first operable position and a second stored position, and wherein the second shelf support member and the shelf are both rotatable relative to the first shelf support member when moving from the first operable position to the second stored position, and wherein the first shelf support member and the second shelf support member are pivotally coupled to one another such that rotation of the second shelf support member toward the first shelf support member moves the folding frame assembly from the first operable position, in which the shelf is inclined at a first angle with respect to the floor surface upwardly from the first shelf support member toward the second shelf support member, to the second stored position.

6. The cart of claim 5, further including a locking member locking the shelf relative to the second shelf support member when the shelf is supported by the second shelf support member in the first operable position.

7. The cart of claim 6, wherein the locking member includes a sloped surface, a recess, a keyway, and a user interface, the locking member being movable along an axis defined by the keyway.

8. The cart of claim 5, wherein in the first operable position, the shelf presents a shelf surface defining a plane that is angled greater than 10 degrees with respect to the floor surface.

9. The cart of claim 5, wherein in the second stored position, the shelf presents a shelf surface inclined at a second angle greater than the first angle with respect to the floor surface.

10. The cart of claim 5, wherein the shelf includes a retaining wall at one end, the retaining wall including a centrally located recess.

11. The cart of claim 10, wherein the recess is sized and shaped to receive a dispenser of a container.

12. The cart of claim 5, further including a second, pivotable shelf supportable by the folding frame assembly and pivotably coupled to the first shelf support member about a pivot point on the first shelf support member.

13. A cart for moving product over a floor surface, the cart comprising:

a folding frame assembly including a first shelf support member, and a second shelf support member pivotable with respect to the first shelf support member;

and a shelf including an open end, a closed end, and a pair of sidewalls, the shelf being rotatably coupled to the first shelf support member and lockably engageable with the second shelf support member, wherein the second shelf support member and the shelf are movable between a first position in which the shelf is inclined at a first angle relative to the floor surface and a second position in which the shelf is unlocked from the second shelf support member, wherein the shelf is inclined at a second angle relative to the floor surface, and wherein the second shelf support member comprises a first section and a second section that is continuous with and angled relative to the first section.

14. The cart of claim 13, wherein the shelf includes a retaining wall at one end, the retaining wall including a centrally located recess.

15. The cart of claim 14, wherein the recess is sized and shaped to receive a dispenser of a beverage container.

16. The cart of claim 13, wherein the first shelf support member and the second shelf support member are pivotally coupled to one another such that rotation of the second shelf support member toward the first shelf support member moves the folding frame assembly from the first position in which the shelf releasably engages the second shelf support member to the second position, and wherein the first position is an operable position and the second position is a stored position.

17. The cart of claim 13, further comprising a locking member disposed on the shelf to releasably engage the shelf with the second shelf support member in the second position.

18. The cart of claim 17, wherein the second shelf support member includes a shelf support bar and the locking member releasably engages the shelf support bar in the second position.

19. The cart of claim 18, wherein the locking member includes a sloped surface, a recess, a keyway, and a user interface, the locking member being movable along an axis defined by the keyway to releasably engage the shelf support bar in the second position.

20. The cart of claim 1, wherein the first angle is between 3 and 25 degrees, and the second angle is between 70 and 90 degrees.

* * * * *